US005722858A

United States Patent [19]

Lan-Jen

[11] Patent Number: 5,722,858

[45] Date of Patent: Mar. 3, 1998

[54] PRONG STRUCTURE OF A PLUG

[76] Inventor: Tsang Lan-Jen, No. 1, Lane 199, Sec. 1, Min Chuan Rd., Tainan, Taiwan

[21] Appl. No.: 762,775

[22] Filed: Dec. 10, 1996

[51] Int. Cl.[6] ..... H01R 13/40

[52] U.S. Cl. ..... 439/601; 439/881

[58] Field of Search ..... 439/881, 884, 439/601

[56] References Cited

U.S. PATENT DOCUMENTS 2,813,258 11/1957 Klumpp, Jr. ..... 439/881

*Primary Examiner*—P. Austin Bradley
*Assistant Examiner*—Barry M.L. Standig
*Attorney, Agent, or Firm*—Morton J. Rosenberg; David I. Klein; Jun Y. Lee

[57] ABSTRACT

A prong structure of a plug is made from a rectangular unfolded strip which decreases waste material to a minimum during manufacture. The prong is formed by doubling over the rectangular strip with a lateral base portion formed at the bottom of both sides thereof. One wing of the lateral base portion of the prong is a lateral tie segment with a clip formed at the end, in which the clip is folded to form a U-shaped groove along the short side of the rectangular strip, for fixing a cord therein by closing the groove from both sides. The other wing of the lateral base portion of the prong is a lateral supporting lug, in which a tongue shaped assistant lug is punched out at the root, so that is can be bent to the clip side to fill the space left by a folded portion of the clipping lug to form a stable supporting base.

1 Claim, 6 Drawing Sheets

PRONG STRUCTURE OF A PLUG

BACKGROUND OF THE INVENTION

1. Field of the Invention

The present invention is related to a prong structure of a plug, and more particularly to a design that can decrease the waste material, and further to reduce the production cost.

2. Prior Art

In accordance with a conventional plug, as shown in FIG. 5, it consists of a plastic body A holding a couple of metal prongs B in parallel and vertically with respect to lateral supporting bases B1, and U-shaped clip B2 extending from one end of the lateral supporting base to connect the prongs B with cords C. The metal prongs B each have double structure, in which the two supporting bases B1 are stretched horizontally as a couple of wings at both sides to support the prong B in standing vertically and in a stable condition. For this reason and the fact that the clip B2 is on one end of the supporting base B1, the unfolded strip of the prong B has a straight shape. When punching a row of unfolded prongs B arranged side by side, as shown in FIG. 6, on a blank sheet, the area enclosed between two adjacent unfolded strips is waste material and that waste is so large that the production cost goes up. Generally, speaking, the more the waste material increases, the higher the production cost it will be.

OBJECTS AND SUMMARY OF THE INVENTION

It is therefore one object of this invention to provide a prong structure Of a plug that applies a rectangular unfolded strip instead of the I-shaped unfolded strip to meet the goal of saving material without losing all functions of the conventional prong. The present invention provides a rectangular unfolded strip to lessen the space between two adjacent strips, in which a L-shaped slot closing one end divides a clipping lug and a tie segment connecting the clipping lug to the main body of the unfolded strip, and an n-shaped slot is formed in the corresponding position on the other end, to divide an assistant lug to form a tongue shaped supporting lug. In manufacturing the prong, the rectangular unfolded strip is doubled, and both ends are bent at both sides horizontally and separately from the roots of the n-shaped slot and the tie segment, like two wings. The clipping lug at the end of the tie segment is bent up from both sides to forma U-shaped groove for clipping a cord, and the assistant lug is bent towards the clip side, as an assistant supporting lug to fill the space of the folded wing of the clipping lug to increase the supporting area of this side.

DETAILED DESCRIPTION OF PREFERRED EMBODIMENTS

Figure 1:
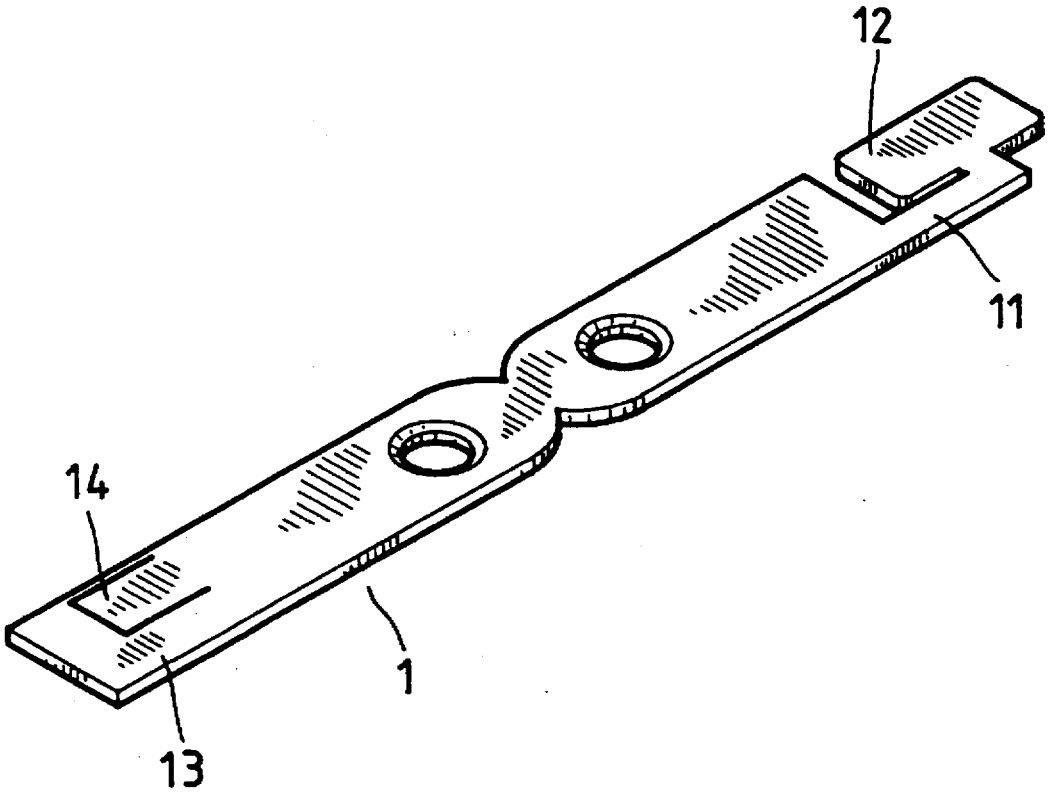
FIG. 1 is a perspective view showing an unfolded strip of the present invention.
Figure 2:
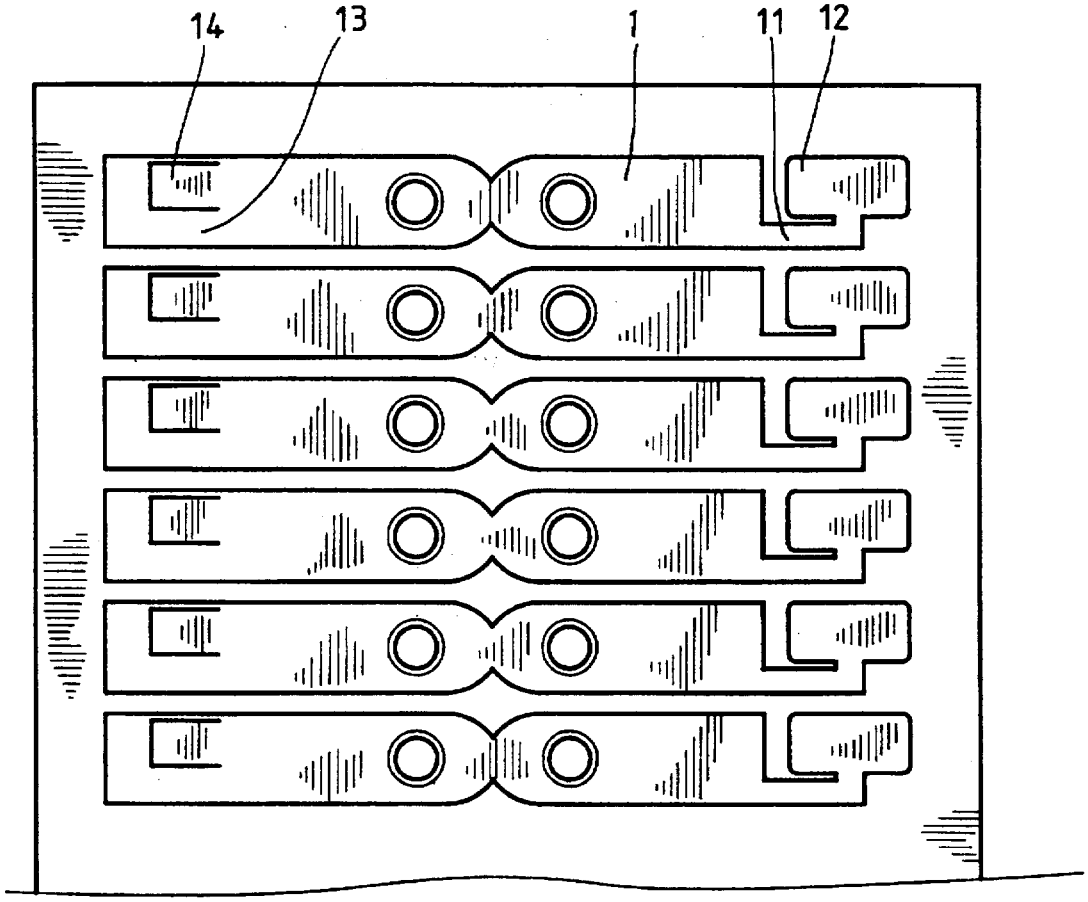
FIG. 2 is a flat view showing the punching sheet of the present invention.

Referring to FIG. 1 and FIG. 2, the present invention relates to a normal rectangular unfolded strip 1 which is produced by punching out from a blank sheet in side by side rows. In that way, the space between the adjacent unfolded strips 1 can be decreased to a minimum. Compared with the above-mentioned conventional prongs, the waste material can be decreased to a minimum.

An L-shaped slot adjacent one end divides a clipping lug 12 and a tie segment 11 that connects the clipping lug 12 to the main body of the unfolded strip 1. An n-shaped slot is formed in the corresponding position on the other end of the strip to divide the strip into a tongue shaped assistant lug 14 and a supporting lug 13.

Figure 3:
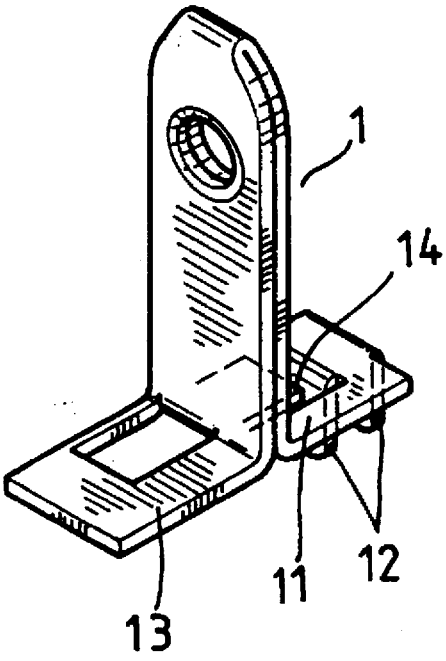
FIG. 3 is a perspective view of the present invention, shown in folded state.

Referring to FIG. 3, in manufacturing the unfolded strip 1 is bent from the center portion thereof and the supporting lug 13 and the tie segment 11, with the clipping lug 12, are bent horizontally towards respective sides, as two out-stretched wings. The clipping lug 12, at the end of the tie segment 11, is bent up from opposing sides to form a U-shaped groove for clipping a cord 3 therein. The assistant lug 14 is bent over to the clip side, as an assistant supporting lug to fill the space of one folded portion of the clipping lug 12, to increase the supporting area of this side, and further make the prong stand with more stability.

Figure 4:
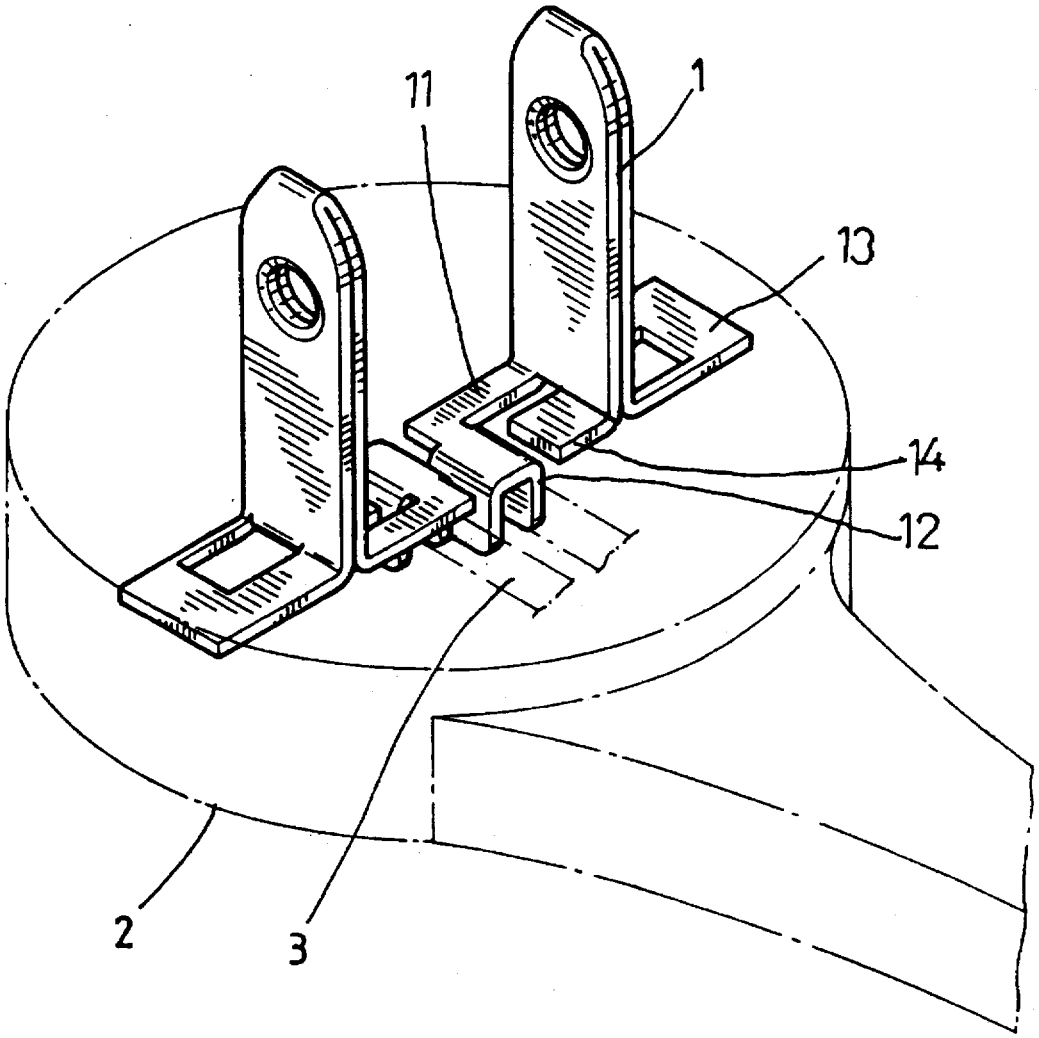
FIG. 4 is a solid view showing the strip of the present invention being installed on a plastic body.
Figure 5:
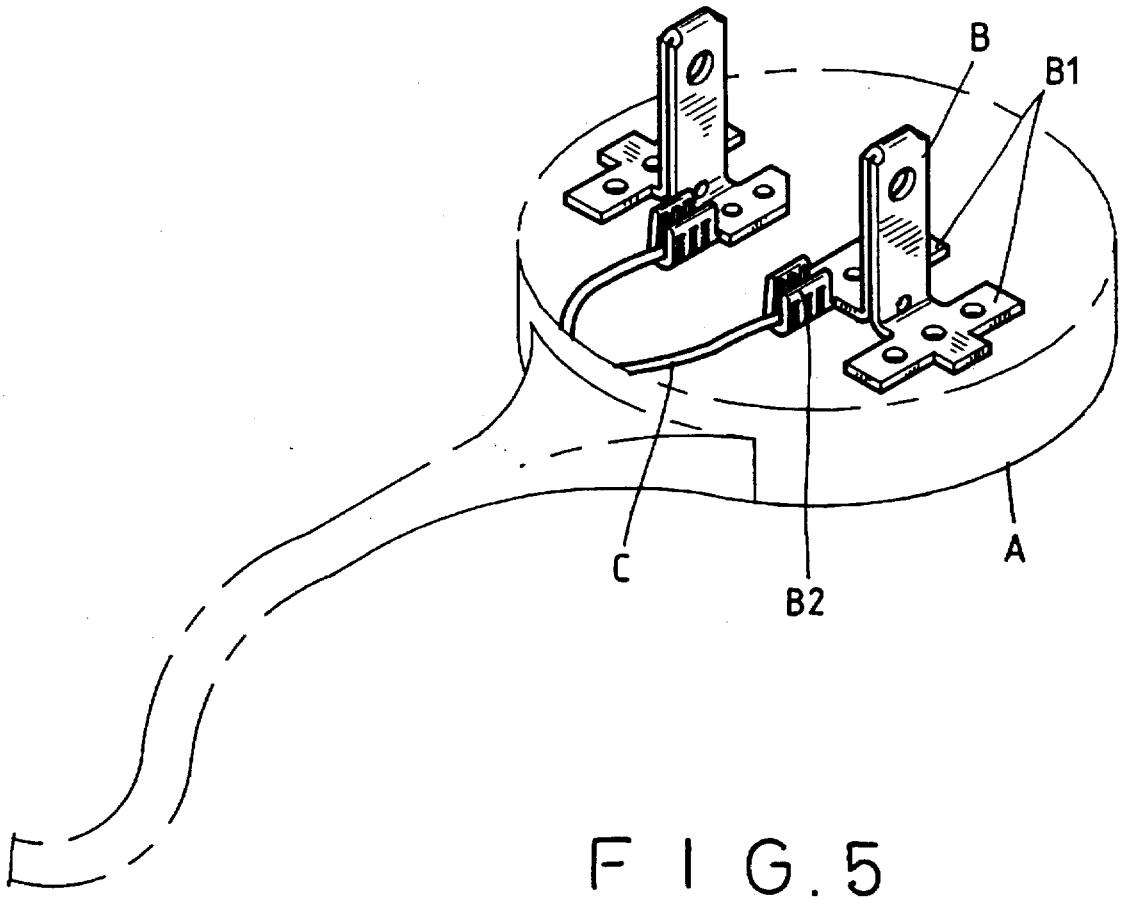
FIG. 5 (PRIOR ART)
FIG. 5 is a perspective view of a conventional plug.
Figure 6:
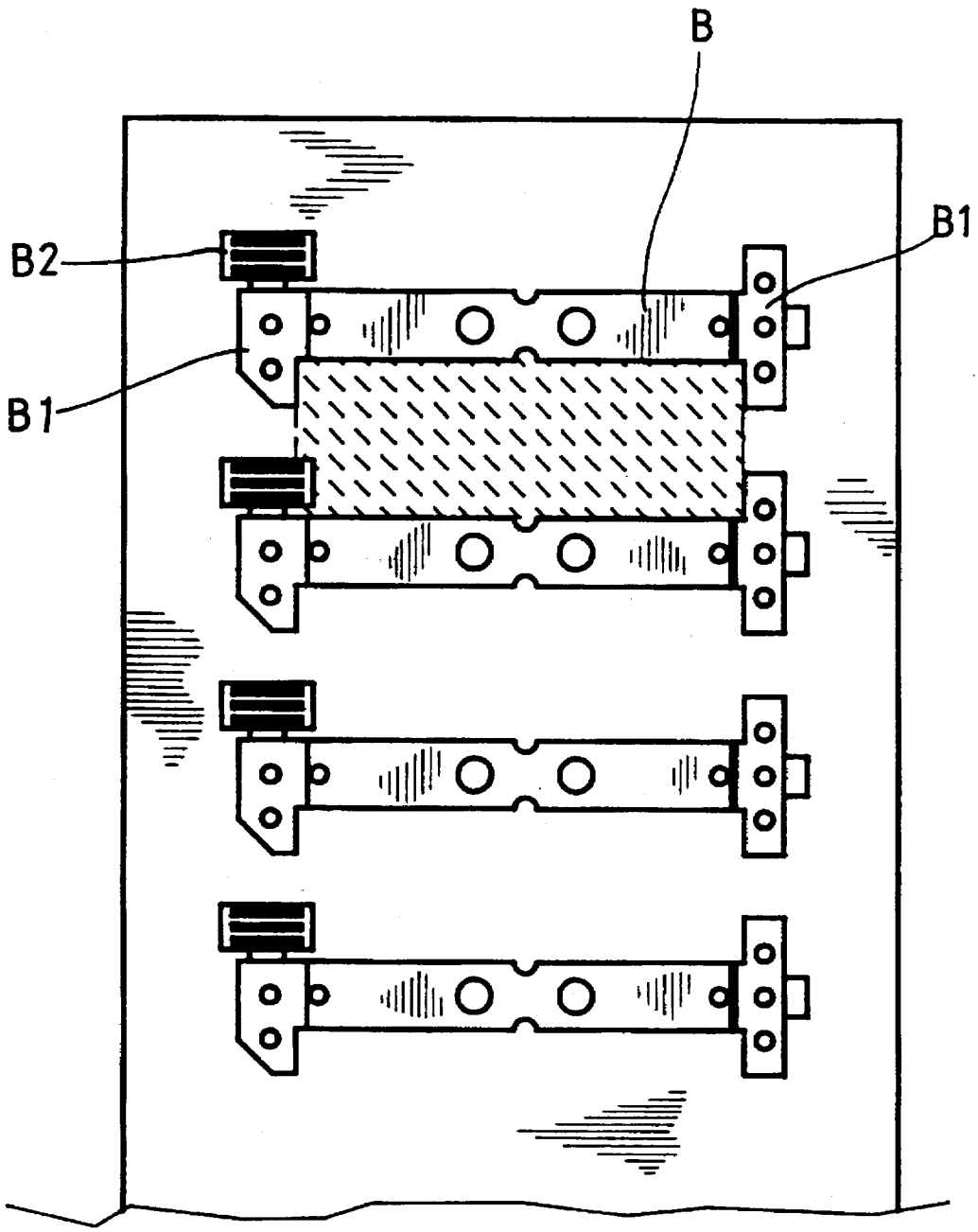
FIG. 6 (PRIOR ART)
FIG. 6 is a flat view showing the punching sheet of conventional prongs.

Referring to FIG. 4, in manufacturing the plug, before being molded with the plastic body 2 into a plug, each prong is connected to the cord 3 by fixing the terminal end of the cord 3 in the clipping lug 12. Then, the plastic body 2 is formed by injection molding plastic into a mold, so that the lateral base portions of the prongs, including the lateral supporting lugs 13, the assistance lugs 14, the tie segments 11 and the clips with cords 3, are enclosed in the plug. Just the prongs are exposed outside the plastic body 2, in a vertical and parallel fashion.

I claim:

1. A prong structure of a plug being formed by a folded rectangular strip and having an open end that is stretched horizontally at both sides of the folded rectangular strip, the improvements comprising:

said rectangular strip having a lateral tie segment with a clip formed at one end therof by a pair of clipping lugs, a lateral supporting lug formed at another end of said rectangular strip, and an assistant lug formed from said supporting lug, wherein when folding said rectangle strip, said clipping lugs on respective sides of said tie segment are bent to form a U-shaped groove for clipping a cord therein, said assistant lug being bent toward said lateral tie segment to fill a space left by one of said pair of clipping lugs to form a stable supporting base.

* * * * *